United States Patent [19]

Drosdziok et al.

[11] Patent Number: 4,958,679

[45] Date of Patent: Sep. 25, 1990

[54] CONDENSER FOR THE WATER-STEAM LOOP OF A POWER PLANT, IN PARTICULAR A NUCLEAR POWER PLANT

[75] Inventors: Armin Drosdziok, Essen; Harry Sauer, Eckenhaid; Walter Zoerner, Baiersdorf-Igelsdorf, all of Fed. Rep. of Germany

[73] Assignee: Siemens Aktiengesellschaft, Munich, Fed. Rep. of Germany

[21] Appl. No.: 189,765

[22] Filed: May 3, 1988

[30] Foreign Application Priority Data

May 4, 1987 [DE] Fed. Rep. of Germany ..... 3714788
May 25, 1987 [DE] Fed. Rep. of Germany ..... 3717521

[51] Int. Cl.[5] ..... F28B 11/00; G01D 5/00; F22D 1/50

[52] U.S. Cl. ..... 165/13; 165/112; 165/113; 60/661; 60/686

[58] Field of Search ..... 165/13, 112, 113; 60/661, 686

[56] References Cited

U.S. PATENT DOCUMENTS

| | | | |
|---|---|---|---|
| 1,522,290 | 1/1925 | Ehrhart . | |
| 3,094,165 | 6/1963 | Droescher | 165/113 |
| 3,362,132 | 1/1968 | Schellenberg . | |
| 3,660,980 | 5/1972 | Knirsch et al. | 60/686 |
| 3,698,476 | 10/1972 | Wyzalek et al. | 165/113 |
| 4,220,194 | 9/1980 | Shade, Jr. et al. | 165/113 |
| 4,365,476 | 12/1982 | Masuda et al. | 60/686 |
| 4,592,419 | 6/1986 | Ishida et al. | 165/112 |

FOREIGN PATENT DOCUMENTS

| | | | |
|---|---|---|---|
| 0152920 | 8/1985 | European Pat. Off. . | |
| 0215230 | 3/1987 | European Pat. Off. . | |
| 0721326 | 3/1932 | France | 165/113 |
| 0064485 | 4/1983 | Japan | 165/113 |
| 60-17695 | 1/1985 | Japan . | |
| 60-80087 | 5/1985 | Japan . | |
| 61-16878 | 7/1986 | Japan . | |
| 0265489 | 11/1986 | Japan | 60/686 |

*Primary Examiner*—John Ford
*Attorney, Agent, or Firm*—Herbert L. Lerner; Laurence A. Greenberg

[57] ABSTRACT

A condenser for the water-steam loop of a power plant includes a condensate-filled lower portion. A heating pipe system is disposed in the lower portion and nozzles are disposed on the heating pipe system through which heating condensate or heating steam is forced into the condensate for heating the condensate and thereby expelling dissolved gases from the condensate. A heating valve is connected to the heating pipe system and a proportional regulator is connected to the heating valve for adjusting heating output of the heating pipe system through the quantity of hot condensate or hot steam. A measurement variable converter connected to the proportional regulator acts upon the proportional regulator at least as a function of oxygen content of the condensate and as a function of subcooling of the condensate, the subcooling being equal to the difference between the temperature of the condensate and the temperature of condensation of steam to be condensed. A vacuum pump communicates with the lower portion for removing expelled gases by suction. The measurement variable converter feeds a measurement result to the proportional regulator causing opening of the heating valve only as long as the vacuum pump is in operation.

12 Claims, 1 Drawing Sheet

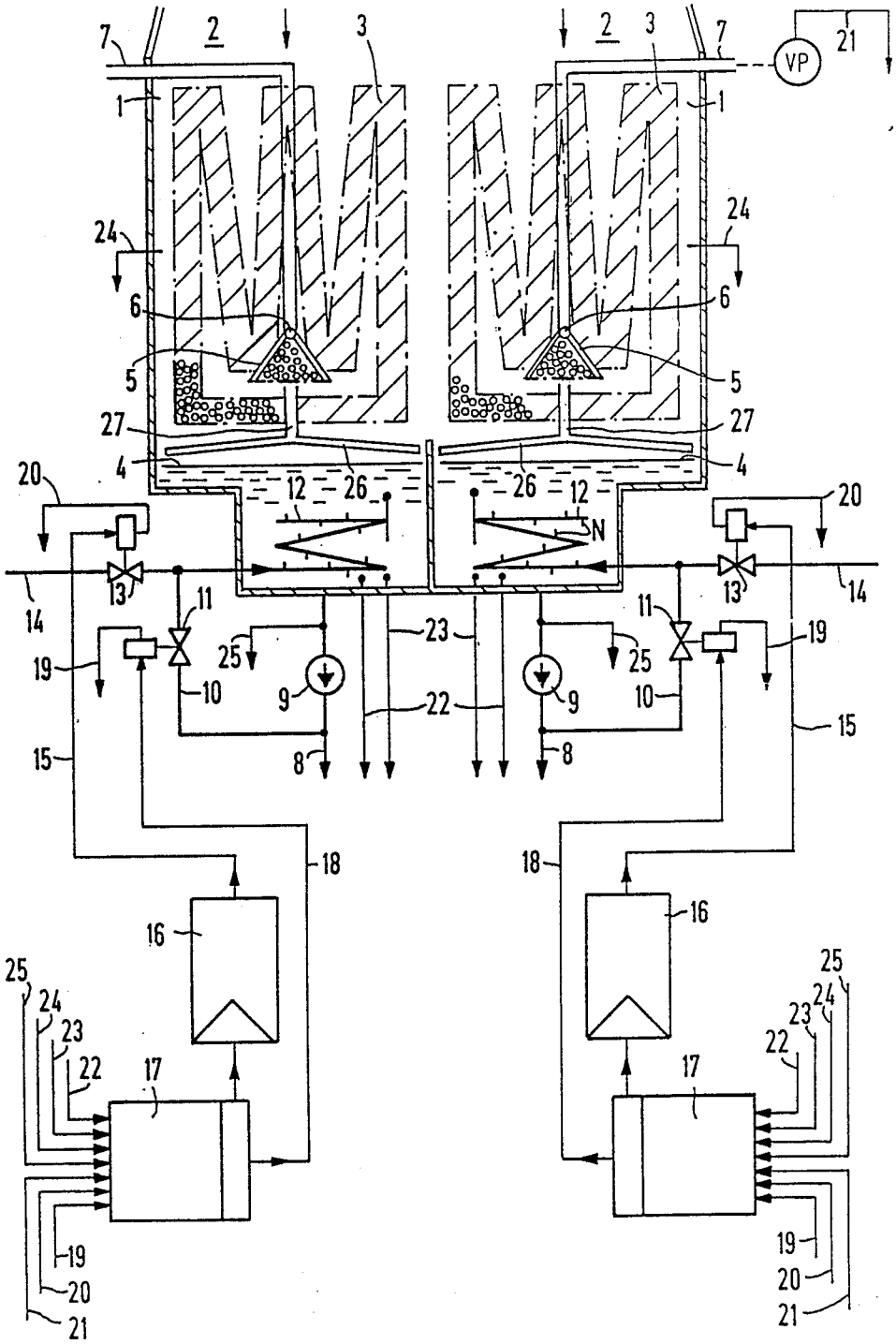
VP
N

CONDENSER FOR THE WATER-STEAM LOOP OF A POWER PLANT, IN PARTICULAR A NUCLEAR POWER PLANT

The invention relates to a condenser for the water-steam loop of a power plant, in particular a nuclear power plant, having a heating pipe or sparger system in a condensate-filled lower portion, and nozzles on the heating pipe through which hot condensate or hot steam is forced into and heats the condensate, thus expelling dissolved gases from the condensate.

In steam power plants without feedwater vessels, such as nuclear power plants from United States manufacturers, a heating pipe or sparger system is installed in the condenser. During startup the heating pipe or sparger system is fed with auxiliary steam and during power operation it is fed with steam from the water-steam loop. The system in these plants is constructed in such a way that only the amounts of condensate produced in the lower load range are heatable, in order to reliably degas the condensate. With this configuration, further problems also arise in the degassing of the condensate, because the air suction units are often overloaded in the partial-load range, and the gases liberated by the degassing cannot be adequately removed by suction through a nest of air cooler pipes. If a supply of deionized water is added, then the oxygen content in the condensate undesirably increases as well, because the deionized water additionally absorbs oxygen as it runs down the pipes.

An impermissible concentration of the oxygen content in the condensate is to be avoided by heating the condensate. In the known apparatus, the extent of heating of the condensate is ascertained by intermittent sampling of the oxygen content. This does not preclude overheating and vaporization of the condensate, because the heating is for the most part unmonitored. Moreover, this leads to relatively high heat losses and possibly even to power losses of the power plant, if the heating pipe system is in operation longer than absolutely necessary. Furthermore, when increased condensate temperatures occur, there is the danger that the condensate pumps will be damaged by cavitation.

In the prior art plants, the heating pipe system is manufactured from unalloyed carbon steel. Corrosion therefore occurs with intermittent operation. During operation, the products of corrosion can be carried into the steam generator or even into the nuclear reactor, in the case of boiling water reactors. In order to eliminate the products of corrosion, if a condensate cleaning apparatus present, it is put into operation frequently and for a long period, which entails additional operating costs. Corrosion products carried into this steam generator with the feedwater consequently cause considerable corrosion problems in the steam generator piping.

It is accordingly an object of the invention to provide a condenser for the water-steam loop of a power plant, in particular a nuclear power plant, which overcomes the hereinafore-mentioned disadvantages of the heretofore-known devices of this general type and which provides a heating pipe system for heating the condensate in condensers of large power plants having a water-steam loop in a closed system, which assures reliable degassing of the condensate and thereby largely prevents corrosion of the condenser components as well as of the components connected to the output side thereof, while at the same time avoiding an impermissible heating of the condensate and thus both precluding the occurrence of cavitation on a condensate pump and narrowly limiting an impairment of efficiency in the total plant. The heating system is to do so independently of the operating state, up to an allowable intermittent overload of the water-steam loop.

With the foregoing and other objects in view there is provided, in accordance with the invention, a condenser for the water-steam loop of a power plant, especially a nuclear power plant, comprising a condensate-filled lower portion, a heating pipe or sparger system disposed in the lower portion, nozzles disposed on the heating pipe system through which heating condensate or heating steam is forced into the condensate for heating the condensate and thereby expelling dissolved gases from the condensate; a heating valve connected to the heating pipe system, a proportional regulator connected to the heating valve for adjusting heating output of the heating pipe system: through the quantity of hot condensate or hot steam: a measurement variable converter connected to the proportional regulator and acting upon the proportional regulator at least as a function of oxygen content of the condensate and as a function of subcooling of the condensate, the subcooling being equal to the difference between the temperature of the condensate and the temperature of condensation of steam to be condensed; and a vacuum pump communicating with the lower portion for removing expelled gases by suction; the measurement variable converter feeding a measurement result to the proportional regulator causing opening of the associated heating valve only as long as the vacuum pump is in operation.

In accordance with another feature of the invention, there are provided two condensation chambers, at least one other heating pipe system, another proportional regulator and another measurement variable converter, each of the condensation chambers being assigned at least one heating pipe system, one proportional regulator and one measurement variable converter.

In accordance with a further feature of the invention, there are provided means for deriving the condensation temperature from the mean pressure of the steam to be condensed in the condenser.

In accordance with an added feature of the invention, there is provided a plurality of measurement sensors through which the temperature of the condensate is ascertained, at least one of the sensors being disposed above the heating pipe system.

In accordance with an additional feature of the invention, there are provided means for determining the heating output of the heating pipe system primarily from the subcooling of the condensate, wherein the heating output is inversely proportional to the subcooling, so that the heating time is longer with a small difference than with a great difference. Subcooling means the difference in temperature between the condensate and the temperature of condensation.

In accordance with yet another feature of the invention, there are provided means for interrupting the feeding of deionized water into the condenser or for feeding deionized water below the heating pipe system directly into the condensate during heating and during operation in a lower power range.

In accordance with yet a further feature of the invention, there is provided a suction apparatus just or directly above the level of the condensate, a line connected to the suction apparatus, and an air cooler communicating with the suction apparatus through the line and/or a pipe leading from the air cooler to the vacuum pump.

In accordance with a concomitant feature of the invention, there is provided a condensate pump communicating with the lower portion, flushing valve means connected between the condensate pump and the heating pipe system for preventing stoppage corrosion in the heating pipe system by returning a portion of the condensate pumped by the condensate pump through the heating pipe system into the condenser between individual heating periods.

The condenser constructed and connected in accordance with the invention enables reliable degassing of the condensate and therefore, because of the absence of oxygen, assures largely corrosion-free operation. Problematic consequences, in particular those caused by products of corrosion, as well as any notable impairment in overall plant efficiency, are avoided by the purposely limited heating of the condensate provided by the invention.

Other features which are considered as characteristic for the invention are set forth in the appended claims.

Although the invention is illustrated and described herein as embodied in a condenser for the water-steam loop of a power plant, in particular a nuclear power plant, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawing.

The drawing is a diagrammatic and schematic circuit diagram of a condenser according to the invention.

Referring now to the single figure of the drawing in detail, there is seen a condenser connected to the output side of a turbine in a water-steam loop of a power plant. The condenser has two chambers 1, each of which has an upper end connected to the outlet of a low-pressure turbine. Both chambers 1 are penetrated by a very great number of pipes through which cooling fluid flows in zones 3 defined by dot-dash lines and filled in with shaded lines. The penetration is transversely to the flow direction of the steam, at right angles to the plane of the drawing. The steam condenses on the outside of the tubes, and the resultant condensate drips downward, filling the condenser up to a level 4.

An air cooler 5 which is open toward the bottom and the top and is formed by walls inclined toward one another in gable-like fashion, is disposed in the lower third of the steam-filled space of the condenser. The air cooler 5 is connected to a vacuum pump VP through a pipe 7 and a suction pipe 6 disposed on the apex of the air cooler. The space encompassed by the air cooler 5 is likewise penetrated by a great number of pipes through which cooling fluid flows, so that the partial pressure of the steam at that location is very low and substantially only the other gases are removed by suction.

A condensate pump 9 pumps the condensate into a non-illustrated feedwater preheater through one condensate line 8 is assigned to each chamber 1. A return line 10 which has a flushing system valve 11 and is parallel to the condensate pump 9, allows just enough condensate to flow back through the return line 10 into the condenser to avoid stoppage corrosion in the heating line system when a valve 13 is closed.

The outflow of returned condensate into the condenser is effected through nozzles N on a heating pipe system such as a sparger pipe system 12. Each chamber 1 has its own heating pipe system 12. Each of the heating pipe systems 12 is located completely below the level 4 and enables regulated heating of the condensate. To this end, after the complete closure of the flushing valve 11, the heating valve 13 opens into a heating line 14 that carries heating steam or heating condensate.

A measurement variable converter 17 has an output connected to an input of a proportional regulator 16 for regulating a flowthrough quantity through the proportional regulator 16 which acts upon the heating valve 13 through a control line 15. The measurement variable converter 17 also directly effects a prior closure of the flushing valve 11 through a control line 18. Feedback reports on the position of the flushing valve 11 are made through a measurement line 19, feedback reports on the position of the heating valve 13 are made through a measuring line 20, and both are fed to the measurement variable converter 17. A measuring line 21 feeds values relating to the operating status of the non-illustrated vacuum pumps located at the end of the pipe 7, to the measurement variable converter 17.

The measurement variable converter 17 also receives other measured values, specifically it receives the oxygen content through a measuring line 22, the temperature in the condensate through a measuring line 23, the mean pressure in the steam chamber of the condenser through a measuring line 24 and the condensate temperature at the intake connection of the condensate pump 9 through a measuring line 25. Reference numerals 19–25 also point to lines in the upper part of the figure having arrows indicating connections to the lines leading to the converter 17. The other ends of these lines with the arrows have dots indicating sensors.

The steam flowing out of the low-pressure turbine into one of the chambers 1 during normal operation of the plant is cooled and condensed on the pipes through which coolant flows in the zones 3, as mentioned above. The condensate flows into the lower portion of the condenser and fills it up to the level 4. The air cooler 5 provided in the lower third of the steam chamber of the condenser cools the low-pressure steam, which is unavoidably mixed in a closed loop with small quantities of gases such as oxygen not condensable in the steam condenser. Inside the air cooler 5, the partial pressure of the steam attains a minimum value, so that the undesirable gases, such as oxygen, are removed by suction to an increased extent through the suction pipe 6.

Although the condensate running downward readily absorbs gases again along its way, these gases do not reach the air cooler 5 if no further degassing possibilities are provided. The condensate in the lower portion of the condenser accordingly contains dissolved gases. If a feedwater vessel is present, then the condensate as a rule is degassed there.

If a feedwater vessel is not provided, the dissolved gases are suitably already expelled in the condenser. To this end, the intrinsically subcooled condensate that has reached the lower portion of the condenser is heated to just below the temperature of condensation corresponding to the pressure in the steam portion of the condenser, so that it practically loses its solubility for gases. The gas bubbles rising out of the condensate are intercepted just above the level 4 by a suction apparatus 26 and are carried through a pipe 27 to the air cooler 5.

The heating of the condensate is effected in accordance with the invention by regulating the quantity of heating condensate or heating steam delivered. The heating valve 13 that sets this quantity is in turn adjusted by the proportional regulator 16, at least as a function of the subcooling and of the oxygen content of the condensate, the magnitude thereof being ascertained by the measurement variable converter 17 from the measured values furnished through the measuring lines 22, 23 and 24. Signals derived from the measured values proceed through the output of the measurement variable converter 17 to the input of the proportional regulator 16. The measurement variable converter 17 also acts on the proportional regulator 16 as a function of the condensate temperature at the intake connection of the condensate pump 9. However, the basic precondition for an opening of the heating valve 13 is that the associated filling valve 11 is closed and the associated vacuum pump has been reported to be in operation through the measuring line 21.

The regulated heating of the condensate on one hand assures that the function and output of the condenser are not impaired, and on the other hand assures that no gases dissolved in the condensate are pumped along with it into the water-steam loop, where the oxygen, in particular, would produce undesirable consequences by forming corrosion products. More-pronounced heating of the condensate, possibly to above the temperature of condensation in the steam chamber of the condenser, which would moreover worsen the efficiency of the overall plant, is reliably prevented by the apparatus according to the invention.

We claim:

1. Condenser for the water-steam loop of a power plant, comprising:

a condensate-filled lower portion, a heating pipe system disposed in said lower portion, nozzles disposed on said heating pipe system through which heating condensate or heating steam is forced into the condensate for heating the condensate and thereby expelling dissolved gases from the condensate;

a heating valve connected to said heating pipe system, a proportional regulator connected to said heating valve for adjusting heating output of said heating pipe system through the quantity of hot condensate or hot steam;

a measurement variable converter connected to said proportional regulator and having means for acting upon said proportional regulator at least as a function of oxygen content of the condensate and as a function of subcooling of the condensate, the subcooling being equal to the difference between the temperature of the condensate and the temperature of condensation of steam to be condensed; and a vacuum pump communicating with said lower portion for removing expelled gases by suction;

said measurement variable converter feeding a measurement result to said proportional regulator causing opening of said heating valve only as long as said vacuum pump is in operation.

2. Condenser according to claim 1, wherein said heating pipe system is a sparger pipe system.

3. Condenser according to claim 1, including two condensation chambers, at least one other heating pipe system, another proportional regulator and another measurement variable converter, each of said condensation chambers being assigned at least one heating pipe system, one proportional regulator and one measurement variable converter.

4. Condenser according to claim 1, including means for deriving the condensation temperature of steam to be condensed from the mean pressure of the steam to be condensed in the condenser.

5. Condenser according to claim 1, including a plurality of measurement sensors through which the temperature of the condensate is ascertained, at least one of said sensors being disposed above said heating pipe system.

6. Condenser according to claim 1, including means for determining the heating output of the heating pipe system primarily from the subcooling of the condensate, wherein the heating output is inversely proportional to the subcooling, so that the heating time is longer with a small difference than with a great difference.

7. Condenser according to claim 1, including means for interrupting the feeding of deionized water into the condenser during heating and during operation in a lower power range.

8. Condenser according to claim 1, including means for feeding deionized water below said heating pipe system directly into the condensate during heating and during operation in a lower power range.

9. Condenser according to claim 1, including a suction apparatus just above the level of the condensate, a line connected to said suction apparatus, and an air cooler communicating with said suction apparatus through said line.

10. Condenser according to claim 9, including a pipe leading from said air cooler to said vacuum pump.

11. Condenser according to claim 1, including a suction apparatus just above the level of the condensate, and a pipe leading from said suction apparatus to said vacuum pump.

12. Condenser according to claim 1, including a condensate pump communicating with said lower portion, flushing valve means connected between said condensate pump and said heating pipe system for preventing stoppage corrosion in said heating pipe system by returning a portion of the condensate pumped by said condensate pump through said heating pipe system into the condenser between individual heating periods.

* * * * *